US011999922B2

(12) United States Patent
Kim et al.

(10) Patent No.: US 11,999,922 B2
(45) Date of Patent: Jun. 4, 2024

(54) LUBRICANT COMPOSITION CONTAINING A DETERGENT DERIVED FROM CASHEW NUT SHELL LIQUID

(71) Applicant: The Lubrizol Corporation, Wickliffe, OH (US)

(72) Inventors: Hyungsoo Kim, Hudson, OH (US); James D. Burrington, Gates Mills, OH (US); Nathan J. Bartlett, Matlock (GB); Gary M. Walker, Allestree (GB); John-Louis DiFlavio, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 23 days.

(21) Appl. No.: 17/782,788

(22) PCT Filed: Sep. 28, 2020

(86) PCT No.: PCT/US2020/052993
§ 371 (c)(1),
(2) Date: Jun. 6, 2022

(87) PCT Pub. No.: WO2021/126338
PCT Pub. Date: Jun. 24, 2021

(65) Prior Publication Data

US 2023/0023443 A1 Jan. 26, 2023

Related U.S. Application Data

(60) Provisional application No. 62/951,275, filed on Dec. 20, 2019.

(51) Int. Cl.

| | |
|---|---|
| ***C10M 129/54*** | (2006.01) |
| ***C10M 125/10*** | (2006.01) |
| ***C10M 129/14*** | (2006.01) |
| ***C10M 129/50*** | (2006.01) |
| ***C10M 169/04*** | (2006.01) |
| *C10N 10/04* | (2006.01) |
| *C10N 20/00* | (2006.01) |
| *C10N 20/02* | (2006.01) |
| *C10N 30/04* | (2006.01) |
| *C10N 40/25* | (2006.01) |
| *C10N 70/00* | (2006.01) |

(52) U.S. Cl.
CPC ..... *C10M 129/54* (2013.01); *C10M 125/10* (2013.01); *C10M 129/14* (2013.01); *C10M 129/50* (2013.01); *C10M 169/04* (2013.01); *C10M 2207/028* (2013.01); *C10M 2207/262* (2013.01); *C10M 2207/284* (2013.01); *C10N 2010/04* (2013.01); *C10N 2020/02* (2013.01); *C10N 2020/081* (2020.05); *C10N 2030/04* (2013.01); *C10N 2040/25* (2013.01); *C10N 2070/00* (2013.01)

(58) Field of Classification Search
CPC ..... C10M 129/54; C10M 125/10; C10M 129/14; C10M 129/50; C10M 169/04; C10M 2207/028; C10M 2207/262; C10M 2207/284; C10M 159/20; C10M 159/22; C10N 2030/04; C10N 2070/00
See application file for complete search history.

(56) References Cited

U.S. PATENT DOCUMENTS

| | | | | |
|---|---|---|---|---|
| 4,627,928 | A | 12/1986 | Karn | |
| 5,910,468 | A * | 6/1999 | Dohhen | C10M 159/22 508/332 |
| 9,550,958 | B2 | 1/2017 | Marsh et al. | |
| 2014/0128301 | A1 | 5/2014 | Glass et al. | |
| 2014/0130758 | A1 | 5/2014 | Marsh et al. | |
| 2016/0200995 | A1 | 7/2016 | Cui et al. | |
| 2016/0201001 | A1 | 7/2016 | Fackler | |
| 2019/0002783 | A1* | 1/2019 | Gill | C10M 129/10 |

FOREIGN PATENT DOCUMENTS

| | | |
|---|---|---|
| EP | 2447346 B1 | 5/2012 |
| EP | 2682451 B1 | 1/2014 |
| JP | H09241675 A | 9/1997 |

* cited by examiner

*Primary Examiner* — Ellen M Mcavoy
(74) *Attorney, Agent, or Firm* — Eryn A. Fuhrer

(57) ABSTRACT

The present invention relates to a lubricating composition comprising a detergent additive derived from raw cashew nut shell liquid. The invention also provides a process for preparing the additive and the use of the lubricating composition in a mechanical device.

31 Claims, No Drawings

LUBRICANT COMPOSITION CONTAINING A DETERGENT DERIVED FROM CASHEW NUT SHELL LIQUID

CROSS REFERENCE TO RELATED APPLICATION

This application claims priority from PCT Application Serial No. PCT/US2020/052993 filed on Sep. 28, 2020, which claims the benefit of U.S. Provisional Application No. 62/951,275 filed on Dec. 20, 2019, the entirety of both of which is hereby, incorporated by reference.

FIELD OF THE INVENTION

The invention provides a lubricating composition containing a detergent additive derived from raw cashew nut shell liquid, a method for making the detergent additive, and a method of using the lubricating composition in a mechanical device.

BACKGROUND

Lubricating oil compositions used to lubricate mechanical devices such as internal combustion engines contain a major portion of a base oil of lubricating viscosity and a variety of lubricating oil additives to improve the performance of the oil. Lubricating oil additives are used to improve detergency, reduce engine wear, provide stability against heat and oxidation, inhibit corrosion and increase engine efficiencies by reducing friction.

Cashew nut shell liquid (CNSL) occurs as a reddish-brown viscous liquid in the soft honeycomb structure of the shell of cashew nut. The cashew nut shell is about 0.3 cm thick, having a soft leathery outer skin and a thin hard inner skin. Between these skins is the honeycomb structure containing the phenolic material popularly known as CNSL. Inside the shell is the kernel wrapped in a thin brown skin, known as the testa.

The nut thus consists of the kernel (20-25%), the shell liquid (20-25%) and the testa (2%), the rest being the shell. Raw CNSL, contains a mixture of anarcadic acid, cardanol, 2-cardol and methylcardol, and is typically 50% or more anacardic acid.

CNSL and its derivates have been known for producing various phenolic detergent compositions as exemplified in U.S. Pat. Nos. 5,910,468, 4,627,498 and 5,218,038.

The conventional method of making phenolic detergents from CNSL involve first distilling the CNSL. Distillation of the of the CNSL results in phenolic derivatives, which are a mixture of biodegradable unsaturated m-alkylphenols, mainly cardanol and cardol. Catalytic hydrogenation of these phenols gives a material which is predominately tetrahydroanacardol. The distilled and/or distilled and hydrogenated CNSL is then reacted with sulphur, metals, or metal oxides or hydroxides at high temperatures (greater than 100°) to provide phenate detergents.

It would be desirable to have a biorenewable and biodegradable lubricant additive composition derived from CNSL that provides unique beneficial properties to a lubricant composition.

SUMMARY OF THE INVENTION

The present invention provides a lubricating composition containing a detergent additive derived from raw cashew nut shell liquid. The lubricating composition may be used in a mechanical device, such as an internal combustion engine.

As used herein reference to the amounts of additives present in the lubricating composition disclosed herein are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

In one embodiment the invention relates to a lubricating composition which comprises an oil of lubricating viscosity, and a detergent comprising an alkaline earth metal salt of a salicylic acid substituted at the 6 position with a hydrocarbyl group, an overbased metal salt of a salicylic acid substituted at the 6 position with a hydrocarbyl group, or combinations thereof. The salicylic acid substituted at the 6 position with a hydrocarbyl group comprises or consists of anacardic acid from raw CNSL.

In another embodiment, the invention relates to a lubricating composition which comprises an oil of lubricating viscosity, and a blend of detergents comprising (A) a neutral or overbased metal salt of alkylsalicylic acid substituted at the 3 or 5 position with a hydrocarbyl group and (B) an alkaline earth metal salt of a salicylic acid substituted at the 6 position with a hydrocarbyl group, an overbased metal salt of a salicylic acid substituted at the 6 position with a hydrocarbyl group, or combinations thereof. The salicylic acid substituted at the 6 position with a hydrocarbyl group comprises or consists of anacardic acid from raw CNSL.

In another embodiment, the present invention relates to a detergent additive comprising a mixture of at least 25% by weight, or at least 40% by weight, or even at least 50% by weight, or about 25% to about 80% by weight of anacardic acid, cardol, and cardanol, an alkaline earth metal oxide or alkaline earth metal hydroxide, and carbon dioxide. The alkaline earth metal oxide and hydroxide may be selected from, for example, Magnesium oxide, Magnesium hydroxide, Calcium oxide, Calcium hydroxide, or even mixtures thereof. The alkaline earth metal hydroxide may be selected from Magnesium hydroxide or Calcium hydroxide.

In another embodiment, the present invention provides a process for preparing an alkaline earth metal salt of a salicylic acid substituted at the 6 position with a hydrocarbyl group, the process comprising: reacting, at a temperature of 70° C. or less, a mixture containing raw cashew nut shell liquid and an alkaline earth metal oxide. In one embodiment, the mixture further contains carbon dioxide. The salicylic acid substituted at the 6 position with a hydrocarbyl group comprises or consists of anacardic acid from raw CNSL.

In still another embodiment, the present invention provides for the use of a detergent additive comprising an alkaline earth metal salt of a salicylic acid substituted at the 6 position with a hydrocarbyl group, an overbased metal salt of a salicylic acid substituted at the 6 position with a hydrocarbyl group, or combinations thereof in a lubricating composition. The salicylic acid substituted at the 6 position with a hydrocarbyl group comprises or consists of anacardic acid from raw CNSL.

In another embodiment, the present invention provides a method of lubricating a mechanical device, such as an internal combustion engine, using a lubricating composition comprising an oil of lubricating viscosity, and a detergent comprising an alkaline earth metal salt of a salicylic acid substituted at the 6 position with a hydrocarbyl group, an overbased metal salt of a salicylic acid substituted at the 6 position with a hydrocarbyl group, or combinations thereof. The salicylic acid substituted at the 6 position with a hydrocarbyl group comprises or consists of anacardic acid from raw CNSL.

DETAILED DESCRIPTION OF THE INVENTION

Aspects according to the present technology are described hereinafter. Various modifications, adaptations or variations of such exemplary aspects described herein may become apparent to those skilled in the art as such are disclosed. It will be understood that all such modifications, adaptations or variations that rely on the teachings of the present technology, and through which these teachings have been advanced in the art, are considered to be within the scope and spirit of the disclosed technology.

The invention disclosed herein provides a detergent composition comprising an alkaline earth metal salt of a salicylic acid substituted at the 6 position with a hydrocarbyl group, an overbased metal salt of a salicylic acid substituted at the 6 position with a hydrocarbyl group, or combinations thereof. The present invention also includes a lubricant composition containing this detergent. Embodiments of the invention include use of the inventive detergent in a mixture with other detergents, a process for making the inventive detergent additive, the use of the inventive detergent additive in a lubricating composition, and a process for using the lubricating composition containing the inventive detergent additive for lubricating a mechanical device, such as an internal combustion engine. The specific details are disclosed herein in the detailed description below.

Oil of Lubricating Viscosity

The oils of lubricating viscosity of can include, for example, natural and synthetic oils, oil derived from hydrocracking, hydrogenation, and hydrofinishing, unrefined, refined and re-refined oils and mixtures thereof. Oils of lubricating viscosity may also be defined as specified in the American Petroleum Institute (API) Base Oil Interchangeability Guidelines.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils and are obtained by processes similar to those used to obtain refined oils and often are additionally processed by techniques directed to removal of spent additives and oil breakdown products. Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof. Synthetic lubricating oils are useful and include hydrocarbon oils such as polymerised and interpolymerised olefins (e.g., polybutylenes, poly-propylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof. Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one aspect, oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content>0.03 wt. %, and/or <90 wt. % saturates, viscosity index 80-120); Group II (sulphur content≤0.03 wt. %, and ≥90 wt. % saturates, viscosity index 80-120); Group III (sulphur content≤0.03 wt. %, and ≥0.90 wt. % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively, the oil of lubricating viscosity is often an API Group II, Group III or Group IV oil or mixtures thereof. In some aspects, the oil of lubricating viscosity used in the described lubricant compositions includes a Group III base oil.

The lubricating oil compositions of the disclosed technology comprise a major amount of oil of lubricating viscosity and a minor amount of one or more N-aralkyl α-carbonyl functional amine(s). The amount of the oil of lubricating viscosity present is typically the balance remaining after subtracting from 100 wt. % the sum of the amount of the additive(s), including the one or more N-aralkyl α-carbonyl functional amine(s) as described hereinbelow.

Detergent Additive Derived from Raw Cashew Nut Shell Liquid

One embodiment of the invention provides an inventive detergent composition which comprises an alkaline earth metal salt and/or an overbased metal salt of a salicylic acid substituted at the 6 position with a hydrocarbyl group. The invention also provides a process for making the detergent comprises from raw CNSL.

Raw CNSL contains a mixture of anarcadic acid, cardanol, 2-cardol and methylcardol, and is typically 50% or more by weight anacardic acid. In one embodiment, the raw CNSL is at least 70% by weight anacardic acid. In another embodiment the raw CNSL is no more than 80% by weight anacardic acid.

In the present invention, the CNSL used to form the detergent is raw CNSL, meaning that the CNSL has not been distilled or subject to processing at high temperatures (e.g above 80° C.). Distilling or exposing the CNSL to high temperatures causes the anacardic acid to decarboxlate resulting in a mixture that is primarily cardanol and cardol. The raw CNSL used in the present invention should comprise less than 50% by weight, or even 30% by weight or less, or even 25% by weight or less, or even 20% by weight cardanol and cardol.

Anacardic acid is represented by the chemical formula:

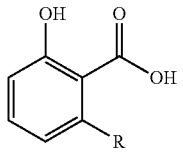

wherein R is a hydrocarbyl group containing 12 to 16 carbon atoms, for example 12 to 15 carbon atoms, further for example, 12 carbon atoms, 13 carbon atoms, 14 carbon atoms, 15 carbon atoms, or 16 carbon atoms and mixtures thereof.

The preparation of detergents from carboxylic acids is generally known to those skilled in the art. For example, methods of forming such detergents are disclosed in U.S. Pat. Nos. 4,719,023 and 3,372,116. However, in the present invention, the preparation of the detergent is done at temperatures of 80° C. or less or even 70° C. or less to avoid decarboxylation of the anacardic acid in the raw CNSL.

The inventive detergent composition of the present invention may be a metal-containing detergent. Metal-containing detergents may be neutral, or very nearly neutral, or overbased. An overbased detergent contains a stoichiometric excess of a metal base for the acidic organic substrate. This is also referred to as metal ratio. The term "metal ratio" is the ratio of the total equivalents of the metal to the equivalents of the acidic organic compound. A neutral metal salt has a metal ratio of one or 1.3 or less. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Third Edition, Edited by R. M. Mortier and S. T. Orszulik, Copyright 2010, page 219, sub-heading 7.25.

In one embodiment the overbased metal-containing detergent may be calcium or magnesium overbased detergent. In one embodiment, the overbased detergent may comprise a calcium alkylphenol detergent with a metal ratio of greater than 1.3, for example at least 1.5, at least 3, at least 5, or at least 7. In certain embodiments, the overbased calcium alkylphenol detergent may have a metal ratio of 1.5 to 25, 2.5 to 20 or 5 to 16.

Alternatively, the inventive detergent of the present invention may be described as having TBN. Overbased carboxylic acid detergents typically have a total base number of 120 to 600 mg KOH/g, or 150 to 550 mg KOH/g, or 180 to 350 mg KOH/g. The amount of the detergent present in a lubricant composition may be defined as the amount necessary to deliver an amount, or range of amounts, of TBN to the lubricant composition. In certain embodiments, the polyolefin-substituted hydroxy-aromatic carboxylic acid containing detergent may be present in a lubricant composition in amount to deliver 0.5 to 10 TBN to the composition, or 1 to 7 TBN, or 1.5 to 5 TBN to the composition. Overbased detergents may also be defined as the ratio of the neutral detergent salt, also referred to as detergent soap, and the detergent ash. The overbased detergent may have a weight ratio of ash to soap of 3:1 to 1:8, or 1.5:1 to 1 to 4.1, or 1.3:1 to 1:3.4.

The detergent of the present invention may beneficially be used as an additive in a lubricant. The amount of the detergent in a lubricant may be 0.1 to 8 percent by weight, on an oil-free basis, but including the calcium carbonate and other salts present in an overbased composition. When present as an overbased detergent, the amount may typically be in the range of 0.1 to 25 weight percent, or 0.2 to 28, or 0.3 to 20, or 0.5 to 15 percent. The higher amounts are typical of marine diesel cylinder lubricants, e.g., 1 or 3 or 5 percent up to 25, 20, or 15 percent. Amounts used in gasoline or heavy-duty diesel engines (not marine) will typically be in lower ranges, such as 0.1 to 10 percent or 0.5 to 5 or 1 to 3 or 1.2 to 2.4 percent by weight. When used as a substantially neutral or non-overbased salt, its amount may typically be correspondingly less for each of the engine types, e.g., 0.1 to 10 percent or 0.2 to 8 or 0.3 to 6 percent. The amount of overbased detergent can also be represented by the amount of metal, specifically alkaline earth metal, delivered to the lubricating composition by the detergent. In one aspect, the overbased detergent is present in an amount to deliver 500 ppm to 3000 ppm, or 800 to 2400 ppm by weight alkaline earth metal to the composition, or combinations of alkaline earth metals. The overbased detergent may be present in an amount to deliver 1000 ppm to 2500 ppm calcium to the composition, or in an amount 100 to 1200 ppm calcium to the composition, or in an amount to deliver 400 ppm to 2500 ppm magnesium to the composition, or combinations thereof. In one embodiment, the lubricating composition comprises at least 400 ppm magnesium or at least 750 ppm magnesium and no more than 1500 ppm calcium from overbased detergents.

In certain embodiments, the amount of the inventive detergent of the present invention may be measured as the amount of soap that is provided to the lubricant composition, irrespective of any overbasing. In one embodiment, the detergent of the present invention provides 15% to 90%, or 25% to 75%, or 35% to 60% by weight to of the total detergent soap in the lubricating composition. In one embodiment, the inventive detergent may be present in an amount to deliver 0.1 to 1.5 weight percent detergent soap to the composition, or 0.35 to 1.2 weight percent detergent soap to the lubricant composition.

In one embodiment, the inventive detergent and mixtures thereof are the only metal-containing detergents contained in the lubricant composition, i.e. the lubricant composition consists of or substantially consists of a metal containing detergent of the invention or combinations thereof.

A lubricant composition may contain detergents in addition to the inventive detergent disclosed herein. In one embodiment, a lubricant composition in accordance with the present invention comprises a mixture of the alkaline earth metal salt and/or an overbased metal salt of a salicylic acid substituted at the 6 position with a hydrocarbyl group as provided herein with another detergent as is described herein below.

The present invention also provides a process for making the detergent comprises reacting raw CNSL with an alkaline earth metal oxide or alkaline earth metal hydroxide. The process comprises reacting, at a temperature of 70° C. or less a mixture containing raw CNSL and an alkaline earth metal oxide. In one embodiment, the raw CNSL comprises about 50% to 80% by weight anacardic acid. The alkaline earth metal comprises or consists of Calcium, Magnesium, or mixtures thereof. In one embodiment, the reaction mixture further contains carbon dioxide, to form a carbonated detergent composition.

Other Detergents

Lubricating compositions in accordance with the present invention may contain another detergent in addition to the inventive detergent. Detergents used in lubricating compositions are typically overbased materials, otherwise referred to as overbased or superbased salts, which are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base or a quaternary ammonium base, and a promoter such as a phenol or alcohol. The acidic organic material will normally have a sufficient number of carbon atoms, to provide oil-solubility.

Overbased detergents can be characterized their TBN, the amount of strong acid needed to neutralize all of the material's basicity, which may be expressed as mg KOH per gram of sample. Since overbased detergents are commonly provided in a form which contains diluent oil, for the purpose of this document, TBN is to be recalculated (when referring to a detergent or specific additive) to an oil-free basis. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one aspect, the metals are sodium, magnesium, or calcium. The anionic portion of the salt can be hydroxide, oxide, carbonate, borate, or nitrate.

In one aspect, the lubricant can contain an overbased sulfonate detergent. Suitable sulfonic acids include sulfonic and thiosulfonic acids, including mono or polynuclear aromatic or cyclo-aliphatic compounds. Certain oil-soluble sulfonates can be represented by $R^{10}$-$T(SO_3^-)_a$ or $R^{11}(SO_3^-)_b$, where a and b are each at least one; T is a cyclic nucleus such as benzene or toluene; $R^{10}$ is an aliphatic group such as alkyl, alkenyl, alkoxy, or alkoxyalkyl; $(R^{10})$-T typically contains a total of at least 15 carbon atoms; and $R^3$ is an aliphatic hydrocarbyl group typically containing at least 15 carbon atoms. The groups T, $R^{10}$, and $R^{11}$ can also contain other inorganic or organic substituents. In one aspect, the sulfonate detergent may be a predominantly linear alkylbenzenesulfonate detergent having a metal ratio of at least 6 or at least 8 as described in paragraphs [0026] to [0037] of U.S. Pat. No. 7,407,919. In some aspects, the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^{15})_a$—Ar—$(OH)_b$, wherein $R^{15}$ is an aliphatic hydrocarbyl group of 4 to 400, or 6 to 80, or 6 to 30, or 8 to 25, or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^{15}$ groups for each phenol compound. Phenate detergents are also sometimes provided as sulfur-bridged species. In one embodiment, the lubricant composition is free of or substantially free of (i.e. contains less than 0.05 weight percent) of a phenate detergent derived from a C10 to C18 alkylphenol.

In one aspect, the overbased material is an overbased saligenin detergent. Overbased saligenin detergents are commonly overbased magnesium salts which are based on saligenin derivatives. A general example of such a saligenin derivative can be represented by formula (III):

(III)

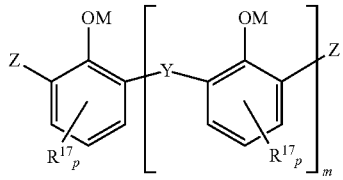

wherein Z is —CHO or —$CH_2OH$, Y is —$CH_2$— or —$CH_2OCH_2$—, and the —CHO groups typically comprise at least 10 mole percent of the Z and Y groups; M is hydrogen, ammonium, or a valence of a metal ion (that is, if M is multivalent, one of the valences is satisfied by the illustrated structure and other valences are satisfied by other species such as anions or by another instance of the same structure), $R^{17}$ is a hydrocarbyl group of 1 to 60 carbon atoms, m is 0 to typically 10, and each p is independently 0, 1, 2, or 3, provided that at least one aromatic ring contains an $R^{17}$ substituent and that the total number of carbon atoms in all $R^{17}$ groups is at least 7. When m is 1 or greater, one of the Z groups can be hydrogen. In one aspect, M is a valence of a Mg ion or a mixture of Mg and hydrogen. Saligenin detergents are disclosed in greater detail in U.S. Pat. No. 6,310,009, with special reference to their methods of synthesis (column 8 and Example 1) and preferred amounts of the various species of Z and Y (column 6).

Salixarate detergents are overbased materials that can be represented by a compound comprising at least one unit represented by formula (IV) or formula (V):

(IV)

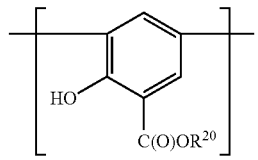

(V)

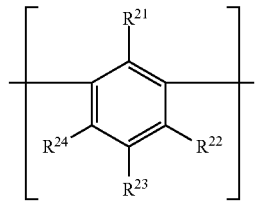

wherein each end of the compound represented by formula (IV) and formula (V) has a terminal group represented by formula (VI) and formula (VII):

(VI)

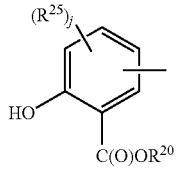

(VII)

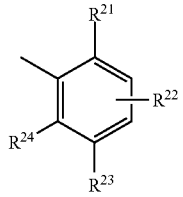

wherein such groups being linked by divalent bridging groups A, which may be the same or different. In formulae (IV) to (VII) $R^{20}$ is hydrogen, a hydrocarbyl group, or a valence of a metal ion or an ammonium ion; $R^{21}$ is hydroxyl or a hydrocarbyl group, and j is 0, 1, or 2; $R^{23}$ is hydrogen, a hydrocarbyl group, or a hetero-substituted hydrocarbyl group; either $R^{21}$ is hydroxyl and $R^{22}$ and $R^{24}$ are independently either hydrogen, a hydrocarbyl group, or hetero-substituted hydrocarbyl group, or else $R^{22}$ and $R^{24}$ are both hydroxyl and $R^{21}$ is hydrogen, a hydrocarbyl group, or a hetero-substituted hydrocarbyl group; provided that at least one of $R^{21}$, $R^{22}$, $R^{23}$ and $R^{24}$ is hydrocarbyl containing at least 8 carbon atoms; and wherein the molecules on average contain at least one of unit (IV) or (VI) and at least one of unit (V) or (VII) and the ratio of the total number of units (IV) and (VI) to the total number of units of (V) and (VII) in the composition is 0.1:1 to 2:1. The divalent bridging group "A", which may be the same or different in each occurrence, includes —$CH_2$— and —$CH_2OCH_2$—, either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate".

Glyoxylate detergents are similar overbased materials which are based on an anionic group which, in one aspect, can have a structure represented by the formula (VIII):

(VIII)

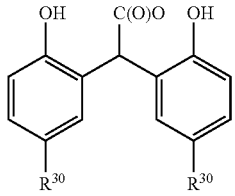

wherein $R^{30}$ is independently an alkyl group containing at least 4 or 8 carbon atoms, provided that the total number of carbon atoms in all $R^{30}$ substitutents is at least 12 or 16 or 24. Alternatively, each $R^{30}$ substituent can be an olefin polymer substituent. The acidic material upon from which the overbased glyoxylate detergent is prepared may be a condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate different from that of the invention, e,g., an alkali metal or alkaline earth metal or ammonium salt of a substituted salicylic acid. A salicylate detergent may be a neutral or overbased metal salt of alkylsalicylic acid. Alkylsalicylic acid may be represented by the formula:

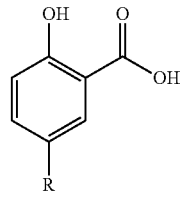

The salicylic acids may be hydrocarbyl-substituted wherein each substituent contains an average of at least 8 carbon atoms per substituent and 1 to 3 substituents per molecule. The substituents can be polyalkene substituents. In one aspect, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain aspects, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some aspects, such hydrocarbyl substituents contain at least 14 or at least 18 carbon atoms.

In one embodiment of the present invention, a lubricating composition is provided which contains a blend of detergents comprising (A) a first detergent comprising an alkaline earth metal salt of a salicylic acid substituted at the 6 position with a hydrocarbyl group, an overbased metal salt of a salicylic acid substituted at the 6 position with a hydrocarbyl group, or combinations thereof and (B) a second detergent different from the first detergent. In one embodiment, the second detergent a neutral or overbased metal salt of alkylsalicylic acid. In one embodiment, the first detergent is 25% to 75% by weight, for example 50% to 75% by weight, of the total detergent blend.

The amount of the total detergent, in the formulations of the present technology, is typically at least 0.6 weight percent on an oil-free basis, or 0.7 to 5 weight percent, or 1 to 3 weight percent.

If the detergents in the lubricant composition are overbased, the amount of overbased detergent can also be represented by the amount of metal, specifically alkaline earth metal, delivered to the lubricating composition by the detergent. In one aspect, the overbased detergent is present in an amount to deliver 500 ppm to 3000 ppm, or 800 to 2400 ppm by weight alkaline earth metal to the composition, or combinations of alkaline earth metals. The overbased detergent may be present in an amount to deliver 1000 ppm to 2500 ppm calcium to the composition, or in an amount to deliver 400 ppm to 2500 ppm magnesium to the composition, or combinations thereof. In one embodiment, the lubricating composition comprises at least 400 ppm magnesium or at least 750 ppm magnesium, and no more than 1500 ppm calcium from overbased detergents.

Dispersants

Dispersants are well-known in the field of lubricants and include primarily what is known as ashless dispersants and polymeric dispersants. Ashless dispersants are so-called because, as supplied, they do not contain metal and thus do not normally contribute to sulfated ash when added to a lubricant. However, they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long-chain alkenyl succinimides, having a variety of chemical structures including those conforming to formula (IX):

(IX)

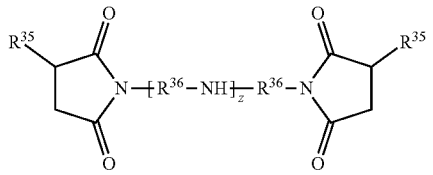

wherein in one aspect, each $R^{35}$ is independently an alkyl group, and in another aspect, a polyisobutylene group with a molecular weight ($M_n$) of 500-5000 based on the polyisobutylene precursor, and $R^{36}$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^{35}$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have general structure (X):

(X)

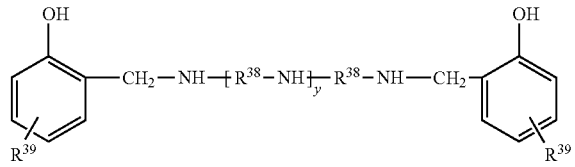

wherein $R^{38}$ is an alkylene group, e.g., an ethylene group (—$CH_2CH_2$—); and $R^{39}$ is a hydrocarbyl substituent having from about 40 to about 20,000 carbon atoms, or from about 80 to about 250 carbon atoms. In one aspect, $R^{39}$ is selected from polyisobutyl and polypropyl substitutents derived from the alkylation of the phenol moiety with polybutylenes or polypropylenes. The foregoing Mannich base dispersants described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are disclosed in U.S. Pat. No. 4,654,403.

The amount of the dispersant in a fully formulated lubricant of the present technology may be at least 0.1% of the lubricant composition, or at least 0.3 wt. %, or 0.5 wt. %, or 1 wt. %, or at least 2 wt %, and in certain aspects, at most 9 wt. %, or 8 wt. %, or 6 wt. %, or 4 wt. %, or 3 wt. %, or 2 wt. %, based on the weight of the total composition.

Viscosity Modifiers

Another performance additive component that can be employed in the lubricant of the disclosed technology is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20 wt. % by weight. Concentrations of 1 to 12 wt. %, or 3 to 10 wt. %, based on the weight of the total lubricant composition may be employed.

Antioxidants

Another performance additive component that can be employed in the lubricant of the disclosed technology is an antioxidant. Antioxidants encompass phenolic antioxidants, which may be hindered phenolic antioxidants, one or both ortho positions on a phenolic ring being occupied by bulky groups such as t-butyl. The para position may also be occupied by a hydrocarbyl group or a group bridging two aromatic rings. In certain aspects, the para position is occupied by an ester-containing group, such as, for example, an antioxidant of the formula (XI):

(XI)

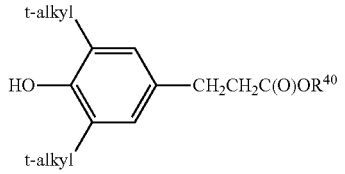

wherein $R^{40}$ is a hydrocarbyl group such as an alkyl group containing, e.g., 1 to 18, or 2 to 12, or 2 to 8, or 2 to 6 carbon atoms; and t-alkyl can be a t-butyl moiety. Such antioxidants are described in greater detail in U.S. Pat. No. 6,559,105.

Antioxidants also include aromatic amines. In one aspect, an aromatic amine antioxidant can comprise an alkylated diphenylamine such as nonylated diphenylamine or a mixture of a di-nonylated and a mono-nonylated diphenylamine, or an alkylated phenylnaphthylamine, or mixtures thereof.

Antioxidants also include sulfurized olefins such as mono- or disulfides or mixtures thereof. These materials generally have sulfide linkages of 1 to 10 sulfur atoms, e.g., 1 to 4, or 1 or 2. Materials which can be sulfurized to form the sulfurized organic compositions of the present technology include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents or friction modifiers. U.S. Pat. No. 4,285,822 discloses lubricating oil compositions containing a molybdenum- and sulfur-containing composition prepared by combining a polar solvent, an acidic molybdenum compound and an oil-soluble basic nitrogen compound to form a molybdenum-containing complex and contacting the complex with carbon disulfide to form the molybdenum- and sulfur-containing composition.

Other materials that may serve as antioxidants include titanium compounds. U.S. Pat. No. 7,727,943 discloses a variety of titanium compounds, including titanium alkoxides and titanated dispersants, which materials may also impart improvements in deposit control and filterability. Other titanium compounds include titanium carboxylates such as neodecanoate.

Typical amounts of antioxidants will, of course, depend on the specific antioxidant and its individual effectiveness, but illustrative amounts of each individual antioxidant or the total of all antioxidants can range from about 0.01 to about 5 wt. %, or from about 0.15 to about 4.5 wt. %, or from about 0.2 to about 4 wt. %, or from 0.8 to about 2.8 wt %, based on the weight of the total composition.

Anti-Wear Agents

The lubricant compositions of the disclosed technology can also contain anti-wear agent. Suitable anti-wear agents include metal-containing and metal-free phosphorus compounds, organic phosphorus-free and sulfur-free compounds, molybdenum compounds, phosphorus-free sulfur compounds, sulfur-free phosphorus compounds, and mixtures and combinations thereof.

In one aspect the anti-wear agent is a metal salt of a phosphorus acid of the formula (XII):

$$[(R^{43}O)(R^{44}O)P(=S)(-S)]_n\text{-}M \quad \text{(XII)}$$

wherein $R^{43}$ and $R^{44}$ are, independently, hydrocarbyl groups containing 3 to 30 carbon atoms, and can be obtained by heating phosphorus pentasulfide ($P_2S_5$) and an alcohol or phenol to form an O,O-dihydrocarbyl phosphorodithioic acid. The alcohol which reacts to provide the $R^{43}$ and $R^{44}$ groups may be a mixture of alcohols, for instance, a mixture of isopropanol and 4-methyl-2-pentanol, and in some aspects, a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates (ZDP). Such materials are well-known and readily available to those skilled in the art of lubricant formulation. Suitable variations to provide good phosphorus retention in an engine are disclosed, for instance, in U.S. Pat. No. 7,772,171.

Examples of materials that may serve as anti-wear agents include phosphorus-containing antiwear/extreme pressure agents such as metal thiophosphates as described above, phosphoric acid esters and salts thereof, phosphorus-containing carboxylic acids, esters, ethers, and amides; and phosphites. In certain aspects, a phosphorus antiwear agent may be present in an amount to deliver from about 0.01 to about 0.2, or from about 0.015 to about 0.15, or from about 0.02 to about 0.1, or from about 0.025 to about 0.08 percent phosphorus. Often the antiwear agent is a zinc dialkyldithiophosphate (ZDP). For a typical ZDP, which may contain 11 percent P (calculated on an oil free basis), suitable amounts may include from about 0.09 to about 0.82 percent. Non-phosphorus-containing anti-wear agents include borate esters (including borated epoxides), dithiocarbamate compounds, molybdenum-containing compounds, and sulfurized olefins.

Other materials that may be used as anti-wear agents include tartrate esters, tartramides, and tartrimides. Examples include oleyl tartrimide (the imide formed from oleylamine and tartaric acid) and oleyl diesters (from, e.g., mixed $C_{12}$-$C_{16}$ alcohols). Other related materials that may be useful include esters, amides, and imides of other hydroxy-carboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in U.S. Pat. No. 7,651,987 and PCT Publication WO WO2010/077630. Such derivatives of (or compounds derived from) a hydroxy-carboxylic acid, if present, may typically be present in the lubricating composition in an amount of from about 0.1 weight % to about 5 wt. %, or from about 0.2 to about 3 wt. %, based on the weight of the total composition.

The amount of each chemical component described herein is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade product.

These additional performance additives may be present in the overall lubricant composition from about 0 or about 0.1 to about 30 wt. %, or from about 1 to about 20 wt. %, or from about 3 to about 20 wt. %, or from about 5 to about 18 wt. %, or from about 8 to about 15 wt. %, or from about 10 to about 12 wt. %, based on the weight of the total composition. The oil of lubricating viscosity will in some aspects make up the balance of the composition, and/or may be present from about 66 to about 99.9 wt. %, or about 99.8 wt. %, or from about 78 to about 98.9 wt. %, or from about 78.5 to about 94.5 wt. %, or from about 78.9 to about 89.1 wt. %, or from about 83.9 to about 89.1 wt. %, or about 85 wt. %, based on the weight of the total composition.

In different aspects, the lubricating composition can have a composition as described in the following table.

| | Aspects (wt %) | | |
|---|---|---|---|
| Additive | A | B | C |
| Overbased Detergent of the Invention | 0.35 to 10 | 0.6 to 5 | 1.2 to 2.8 |
| Other Metal Detergents | 0 to 8 | 0.2 to 4 | 0.5 to 2 |
| Polyolefin Dispersants | 0.8 to 8 | 1 to 6 | 1.5 to 4 |
| Antiwear Agents | 0.15 to 6 | 0.2 to 4 | 0.5 to 2 |
| Ashless Antioxidants | 1.2 to 7 | 1.2 to 5 | 2 to 5 |
| Corrosion Additive | 0.01 to 4 | 0.2 to 2 | 0.35 to 1.5 |
| Viscosity Modifier | 0 or 0.1 to 4.5 | 0.5 to 4 | 0.8 to 2.5 |
| Dispersant Viscosity Modifier | 0 or 0.1 to 4.5 | 0 or 0.1 to 2.5 | 0.5 to 1.6 |
| Friction Modifier | 0 or 0.05 to 4 | 0.05 to 3 | 0.1 to 2 |
| Any Other Performance Additive | 0 or 0.05 to 10 | 0 or 0.05 to 8 | 0 or 0.05 to 6 |
| Oil of Lubricating Viscosity | Balance to 100 % | | |

The lubricating composition of the disclosed technology may be utilized in an mechanical device, for example, an internal combustion engine.

The following examples provide illustrations of the disclosed technology. Unless otherwise specified the amounts of components set forth in the Examples below are given in weight percent based on the weight of the total composition. These examples are non-exhaustive and are not intended to limit the scope of the present technology.

EXAMPLES

A series of overbased metal-containing detergents may be prepared from 4-alkyl salicylic acid, cashew nut shell liquid (anacardic acid, a 6-alkylsalicylic acid), and mixtures thereof. Several examples are provided to illustrate process conditions. Examples of overbased metal-containing detergents are summarized below (Table 1).

Example A—Overbased Calcium Alkylsalicylate

Alkyl salicylic acid (a mixture of C14,16,18 saturated alkyl groups) (100 parts by weight) is mixed with 100 viscosity mineral oil (97.27 pbw). To this are added methanol (22 pbw) and i-butanol/amyl alcohol mixture (70:40 by wt) (22 pbw), $CaCl_2$ aq solution (50%) (2.8 pbw), and hydrated lime (10.27 pbw). The mixture is heated under nitrogen for 1 hr to 55~65° C. and then is heated to 150° C. for 30 min and stripped. The mixture is cooled below 60° C. and methanol (22 pbw) and i-butanol/amyl alcohol mixture (70:40 by wt) (22 pbw) are added. Hydrated lime (15.18 pbw) is added, and the mixture is carbonated at a rate of 280 mL/min until DBN (direct base number) is 10~20. The mixture is heated to 150° C. and striped under vacuum at 30~40 mmHg. 25 mL of the reaction mixture is diluted with 75 mL of n-hexane and centrifuged for % sediment and it is 0.4% by vol. The crude mixture is filtered. A total base number (TBN) may be measured of 169 and % OIL may be 44% and metal ratio may be 3.5.

Example C (Inventive)

Cashew nut shell liquid (CNSL) (100 pbw) is mixed with 100 viscosity mineral oil (97.27 pbw). To this are added methanol (22 pbw) and i-butanol/amyl alcohol mixture (70:40 by wt) (22 pbw), $CaCl_2$) aq solution (50%) (2.8 pbw), and hydrated lime (15.45 pbw). The mixture is heated under nitrogen for 1 hr to 55~65° C. and then the mixture is carbonated at a rate of 280 mL/min until DBN (direct base number) is 10~20. 12.9 parts of hydrated lime is added, and the mixture is carbonated at a rate of 280 mL/min until DBN (direct base number) is 10~20. The mixture is heated to 150° C. and striped under vacuum at 30~40 mmHg. 25 mL of the reaction mixture is diluted with 75 mL of n-hexane and centrifuged for % sediment and it is 4.0% by vol. The crude mixture is filtered. A total base number (TBN) may be measured of 170. % OIL may be 43% and metal ratio may be 3.7.

Examples of overbased metal-containing detergents which can be prepared from CNSL, 5-alkylsalicylic acid, and mixtures thereof are summarized below (Table 1).

TABLE 1

Examples of Overbased Metal-containing Detergents

| | | Substrate (wt %) | | | | |
|---|---|---|---|---|---|---|
| Examples | Metal | Alkylsalicylic acid[1] | CNSL[2] | TBN (mg KOH/g) | Metal Ratio | Oil (wt %) |
| A | Ca | 100 | | 169 | 3.5 | 44 |
| B | Mg | 0 | 100 | 200 | 3.5 | 40 |
| C | Ca | 0 | 100 | 170 | 3.7 | 43 |
| D | Ca | 0 | 100 | 215 | 6.0 | 40 |
| E | Ca | 0 | 100 | 280 | 7.9 | 38 |
| F | Ca | 0 | 100 | 320 | 10.5 | 35.6 |
| G | Ca | 50 | 50 | 170 | 3.0 | 40 |
| H | Ca | 75 | 25 | 180 | 3.2 | 38 |
| I[3] | C1 | 100 | 0 | 170 | 3 | 45 |

[1]A mixture of 3-, and 5- mono- and di-substituted alkyl salicylic acid (85 wt %) with 2- and 4-mono- and di-sustituted alkyl phenol (15 wt %) with a mixture of C14, C16, and C18 saturated alkyl groups

[2]A mixture ofanacardic acid (75 wt %) and Cardol and Cardanol (~25 wt %)

[3]Commercially available overbased calcium alkylsalicylate, available from Osca corporation Lubricating Compositions and Test Data.

A series of 5W-30 engine lubricants in Group III base oils of lubricating viscosity are prepared containing the detergent composition of the present invention as well as conventional additives including polyisobutenyl succinimide dispersants, polymeric viscosity modifier, overbased detergents (different from that of the invention), antioxidants (combination of phenolic ester and diarylamine), zinc dialkyldithiophosphate (ZDDP), as well as other conventional performance additives as follows (Table 2). The calcium, magnesium, phosphorus, zinc and TBN of each of the examples are also presented in the table in part to show that each example has a similar amount of these materials and so provide a proper comparison between the comparative and illustrative examples of the present technology.

TABLE 2

(Lubricating Compositions)[1]

| | EX1 | EX2 | EX3 | EX4 | EX5 | EX6 |
|---|---|---|---|---|---|---|
| Group III Base Oil | Balance to 100% of Composition | | | | | |
| Example A | 2.0 | | | | 1.8 | |
| Example B | | | 2.0 | | | |
| Example C | | 2.0 | | | | |
| Example E | | | | 1.5 | | |
| Example G | | | | | | 2.0 |
| Boron-Free PIB Succinimide[2] | 2.5 | 2.5 | 2.5 | 2.5 | | 1.5 |
| Borated PIB Succinimide[3] | | | | | 2.8 | 1.0 |
| Overbased Calcium Sulfonate[4] | | | 0.3 | 0.2 | 0.3 | |
| Overbased Magnesium Sulfonate[5] | 0.3 | 0.3 | | 0.2 | | 0.4 |
| $C_3/C_6$ Secondary ZDDP | 0.55 | 0.55 | 0.55 | 0.55 | 0.55 | 0.55 |
| Ashless Antioxidant[6] | 2.55 | 2.55 | 2.55 | 2.55 | 2.55 | 2.55 |
| Soot Dispersant[7] | 0.75 | 0.75 | 0.75 | 0.75 | 0.75 | 0.75 |
| OCP DVM | 0.2 | 0.2 | 0.2 | 0.2 | 0.2 | 0.2 |
| Styrene Diene polymer | 0.3 | 0.3 | 0.3 | 0.3 | 0.3 | 0.3 |
| Other Additives[8] | 0.21 | 0.21 | 0.21 | 0.21 | 0.21 | 0.21 |

[1]All treat rates are oil free, unless otherwise indicated
[2]High TBN PIBsuccinimide dispersant prepared from 1000 Mn polyisobutylene
[3]Boron-containing polyisobutenyl succinimide dispersant
[4]Combination of overbased calcium alkylbenzene sulfonate detergents (TBN of 170 and 500 mg KOH/g)
[5]Overbased magnesium alkylbenzene sulfonate (TBN 700 mg KOH/g)
[6]Combination of sulfurized olefins, alkylated diarylamine compounds and hindered phenol ester compounds
[7]Ethylene-propylene copolymers functionalized with a mixture of aromatic amines and aromatic polyamines
[8]Other additives include pourpoint depressant, corrosion inhibitor, and anti-foam agent Examples 1 and 2 from Table 2 are evaluated in bench and engine tests designed to assess the ability of the lubricant to prevent or reduce deposit formation, provide cleanliness, improve oxidation stability and reduce or prevent acid-mediated wear or degradation of the lubricant. The lubricant samples are subjected to industry standard deposit and oxidation tests such as Komatsu Hot Tube (KHT), Pressure Differential Scanning Calorimetry (PDSC) (e.g. L85-99), and the TEOST 33C deposit test (ASTM D6335), as well as standard evaluation on high frequency reciprocating rigs to asses friction and lubricity. Elementals and test data are summarized below (Table 3).

KHT measures the deposit formation tendency of the lubricating composition at high temperature conditions. In KHT, high rating means better deposit control performance. The KHT test employs heated glass tubes through which a sample lubricating composition is pumped (5 mL total sample), at 0.31 mL/hour for 16 hours, with an air flow of 10 mL/minute. The glass tube is rated at the end of test for deposits on a scale of 0 (very heavy varnish) to 10 (no varnish).

The lubricant compositions were assessed for their frictional and wear performance using a high frequency reciprocating rig (HFRR) equipped with a standard steel ball on steel disk. The following test conditions were utilized: 200 N force, frequency of 20 Hz, 75 minutes duration, and temperature was held at 40° C. for 15 minutes and then ramped at 2° C. per minute to a final temperature of 160° C. (60 minute ramp). Coefficient of friction (COF) is measured virtually continuously during the entire test. The average coefficient of friction is determined by averaging all of the measurements during the temperature ramp phase of the procedure. The test procedure has two phases, an initial isothermal stage followed by a ramp phase; the measured value is the average coefficient of friction during the temperature ramp phase only. The coefficient of friction is the frictional force measured parallel to the reciprocation divided by the applied force.

TABLE 3

(Deposits and Oxidation Evaluation)

| | EX1 S010-0106-15-618 | EX2 S010-2658-18-19 |
|---|---|---|
| TBN (D2896) (mg KOH/g) | 9.62 | 9.9 |
| TBN (D4739) (mg KOH/g) | 6.60 | 6.50 |
| Kinematic Viscosity @ 100° C. (D445) | 7.36 | 7.21 |
| High Temperature High Shear Viscosity (D4683) (cP) | 2.43 | 2.40 |
| Calcium (ppm) | 1190 | 1181 |
| Magnesium (ppm) | 490 | 500 |
| Phosphorus (ppm) | 630 | 610 |
| Zinc (PPM) | 700 | 700 |
| TEOST 33C (D6335), Total Deposit(mg) | 44.2 | 45.2 |
| Oxidation Induction Time (min) (L-85-99, OIT) | 107.8 | 109.4 |
| HFRR Coefficient of friction @160° C. | 0.173 | 0.156 |

The data indicates that the lubricant compositions containing the detergent additive of the invention provides equivalent cleanliness and oxidation control with reduced friction performance.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the disclosed technology can be used together with ranges or amounts for any of the other elements. As used herein, the expression "consisting essentially of" permits the inclusion of substances that do not materially affect the basic and novel characteristics of the composition under consideration.

What is claimed is:

1. A detergent comprising the reaction product of:

(a) a mixture of about 25% to 80% by weight of anacardic acid, cardol, and cardanol;

(b) a metal oxide or hydrated equivalent, selected from Magnesium Oxide, Calcium Oxide, or mixtures thereof or metal hydroxide, selected from Magnesium Hydroxide, Calcium Hydroxide, or mixtures thereof;

(c) carbon dioxide wherein the detergent comprises a blend of detergents comprising a metal salt of a salicyclic acid substituted at the 6 position with a hydrocarbyl group, a metal salt of an alkylsalicyclic acid substituted at the 3 or 5 position with a hydrocarbyl group, wherein the detergent has a total base number of 120 to 600 mgKOH.

2. The detergent of claim 1, wherein the metal oxide comprises or consists of Magnesium Oxide.

3. The detergent of claim 1, wherein the metal oxide comprises or consists of Calcium Oxide.

4. The detergent of claim 1, wherein the metal hydroxide comprises or consists of Magnesium Hydroxide.

5. The detergent of claim 1, wherein the metal hydroxide comprises or consist of Calcium Hydroxide.

6. The detergent of claim 1, wherein the mixture contains no more than 80% by weight anacardic acid.

7. The detergent of claim 1, wherein the mixture contains at least about 70% by weight anacardic acid.

8. The lubricant composition of claim 1, wherein the anacardic acid is substituted with a C12-C16 unsaturated hydrocarbyl group.

9. The lubricant composition of claim 8, wherein the anacardic acid is substituted with a C12-C15 hydrocarbyl group.

10. A lubricant composition comprising (i) an oil of lubricating viscosity and (ii) a detergent of claim 1.

11. A process for preparing an alkaline earth metal salt of a salicylic acid substituted at the 6 position with a hydrocarbyl group comprising:

reacting, at a temperature of 70° C. or less, a mixture containing raw cashew nut shell liquid and an alkaline earth metal oxide or alkaline earth metal hydroxide.

12. The process of claim 11, wherein the mixture further contains carbon dioxide.

13. The process of claim 11, wherein the raw cashew nut liquid comprises about 50% to 80% by weight anacardic acid.

14. The process of claim 11, wherein the anacardic acid is substituted with a C12:C16 unsaturated hydrocarbyl group.

15. The lubricant composition of claim 14, wherein the anacardic acid is substituted with a C12-C15 hydrocarbyl group.

16. The process of claim 11, wherein the alkaline earth metal is selected from Magnesium, Calcium, or mixtures thereof.

17. The process of claim 16, wherein the alkaline earth metal comprises or consists of Magnesium.

18. The process of claim 16, wherein the alkaline earth metal comprises or consists of Calcium.

19. A lubricant composition comprising:

(a) an oil of lubricating viscosity;

(b) an alkaline earth metal salt of a salicylic acid substituted at the 6 position with a hydrocarbyl group, an overbased metal salt of a salicylic acid substituted at the 6 position with a hydrocarbyl group, or combinations thereof wherein the salicylic acid substituted at the 6 position with a hydrocarbyl group is anacardic acid derived from raw cashew nut shell liquid.

20. The lubricant composition of claim 19, wherein the alkaline earth metal salt of a salicylic acid substituted at the 6 position with a hydrocarbyl group is carbonated.

21. The lubricant composition of claim 19, wherein the alkaline earth metal is selected from Calcium, Magnesium, or mixtures thereof.

22. The lubricant composition of claim 21, wherein the alkaline earth metal comprises or consists of Magnesium.

23. The lubricant composition of claim 19, wherein the hydrocarbyl group is a C12-C16 unsaturated hydrocarbyl group.

24. The lubricant composition of claim 23, wherein the hydrocarbyl group is a C12-C15 hydrocarbyl group.

25. The lubricant composition of claim 19, wherein the alkaline earth metal salt of a salicylic acid substituted at the 6 position with a hydrocarbyl group is a neutral carbonated alkaline earth metal salt of a salicylic acid substituted at the 6 position with a hydrocarbyl group having a metal ratio of 1.3 or less.

26. The lubricant composition of claim 19, wherein the alkaline earth metal salt of a salicylic acid substituted at the 6 position with a hydrocarbyl group detergent is an overbased carbonated metal salt of a salicylic acid substituted at the 6 position with a hydrocarbyl group, or combinations thereof having a metal ratio of greater than 1.3.

27. The lubricant composition of claim 19, wherein the oil of lubricating viscosity has a viscosity grade of 0W-20 or less.

28. The lubricant composition of claim 19, wherein the oil of lubricating viscosity comprises a mineral oil, a synthetic oil, or a combination thereof.

29. The lubricant composition of claim 19, wherein said oil of lubricating viscosity is at least one of an API Group I oil, Group II oil, Group III oil, and mixtures thereof.

30. The lubricant composition of claim 19, wherein the lubricant composition further comprises an additive selected from one or more ashless dispersants, viscosity modifiers, pour point depressants, antioxidants, friction modifiers, zinc dithiophosphates, detergents, antiwear agents, corrosion inhibitors, antifoam agents, or any combination thereof.

31. The lubricant composition of claim 29 further comprising a neutral or overbased metal salt of alkylsalicylic acid substituted at the 3 or 5 position with a hydrocarbyl group.

* * * * *